US005084112A

United States Patent [19]

Tachino et al.

[11] Patent Number: 5,084,112

[45] Date of Patent: Jan. 28, 1992

[54] HIGH STRENGTH NON-ORIENTED ELECTRICAL STEEL SHEET AND METHOD OF MANUFACTURING SAME

[75] Inventors: Ichiro Tachino; Takeshi Kubota; Toshihiko Uemura; Masahiro Nakamoto, all of Kitakyushu, Japan

[73] Assignee: Nippon Steel Corporation, Tokyo, Japan

[21] Appl. No.: 410,605

[22] Filed: Sep. 21, 1989

[51] Int. Cl.[5] ..... H01F 1/04

[52] U.S. Cl. ..... 148/111

[58] Field of Search ..... 148/111, 112, 110

[56] References Cited

U.S. PATENT DOCUMENTS

| | | | |
|---|---|---|---|
| 4,204,890 | 5/1980 | Irie et al. | 148/111 |
| 4,666,534 | 5/1987 | Miyoshi et al. | 148/111 |
| 4,938,806 | 7/1990 | Honda et al. | 148/111 |

FOREIGN PATENT DOCUMENTS

| | | | |
|---|---|---|---|
| 55-65349 | 5/1980 | Japan . | |
| 59-9123 | 1/1984 | Japan | 148/111 |
| 60-238421 | 11/1985 | Japan . | |
| 61-9520 | 1/1986 | Japan . | |
| 62-256917 | 11/1987 | Japan . | |
| 63-47334 | 2/1988 | Japan | 148/111 |

*Primary Examiner*—John P. Sheehan

*Attorney, Agent, or Firm*—Kenyon & Kenyon

[57] ABSTRACT

A high strength non-oriented electrical steel sheet with good magnetic properties having a yield strength of $\geqq 60$ kg-f/mm$^2$ and a yield point elongation of YP-El$\geqq 0.3\%$ comprising, by weight percent: up to 0.04% carbon; from 2.0% to less than 4.0% silicon; from zero percent to 2.0% aluminum; up to 0.2% phosphorus, and including one or more elements selected from manganese and nickel in an amount within the range $0.3\% \leqq Mn+Ni < 10\%$, with the remainder of iron and unavoidable impurities, and a method of manufacturing the steel.

4 Claims, 1 Drawing Sheet

HIGH STRENGTH NON-ORIENTED ELECTRICAL STEEL SHEET AND METHOD OF MANUFACTURING SAME

BACKGROUND OF THE INVENTION

1. Field of the Invention

This invention relates to electrical steel sheet for rotor cores of motors, and particularly to high strength non-oriented electrical steel sheet having a high yield point and the method of manufacturing same, in which the steel possesses mechanical and magnetic properties that enable it to withstand the stresses and changes in stresses produced by rotation and by changes in the speed of rotation.

2. Description of the Prior Art

In recent years, advances in electronics have led to the provision of more sophisticated drive system functions for motors and other such rotating machines, and to a variety of rotational drive control systems. Specifically, there has been an increase in the use of motors in which, by frequency-control of the power source, the speed of motors can be varied and the motors run at high speeds exceeding the commercial frequencies.

Progress in the development of electromechanical systems is producing an increased need for faster motors. In addition, whereas in the past high speed motors have had relatively small capacities, there is now an increasing demand for medium-sized and large high-speed motors.

In order to realize such high speed motors, rotors are required with a structure that enable them to withstand the high rotational speeds. The centrifugal force acting on a rotating body is proportional to the radius of rotation, and increases proportionally to the square of the speed of rotation. This means that in medium-sized and large high speed motors, the rotor may be subjected to forces exceeding 60 kg-f/mm$^2$.

In the case of very large motors, because the diameter of the rotors is relatively large the rotor may be subjected to forces exceeding 60 kg-f/mm$^2$ even at relatively low speeds, necessitating the use of high strength materials for the rotor.

In addition, variable speed motors are constantly being speeded up or slowed down, which means that the materials used also have to have a high fatigue failure limit (fatigue limit) that will enable them to withstand repeated stresses.

Normally a rotor is made of laminations of non-oriented electrical steel sheet, but in the case of the type of motors described above the mechanical strength of such a rotor may not be sufficient, in which case a solid cast steel rotor is used.

However, inasmuch as motors utilize electromagnetism, the materials employed also need to have good magnetic properties. Of the various magnetic properties required of rotors, core loss and magnetic flux density are of particular importance. Most of the core loss in a rotor is ripple loss, which is loss from high frequency magnetic flux produced on the surface of the core. The frequency $f_R$ concerned is expressed by:

$$f_R = 2 \cdot f_O \cdot M/P$$

Here, $f_O$ is the frequency of the driving power source, M is the number of stator core teeth and P is the number of poles the motor has.

In the case of a two-pole motor that operates at about twice the frequency of a commercial power source, ripple flux frequency would be around 1 to 10 kHz. As such, preferably, within this frequency range the material used for rotors should have a low core loss. However, because the said solid steel rotor is cast as a single piece, at high frequencies the eddy current loss is very high and motor efficiency is several percent lower than when a laminated rotor is used.

Excitation characteristics also are important. A rotor core material with a low magnetic flux density necessitates the use of more exciting ampere-turns to produce sufficient flux to generate the requisite torque. Because this is related to increases in copper loss in the exciting coil, it can produce a drop in the overall efficiency of the motor.

Core loss can be reduced if the solid rotor is replaced by a laminated rotor made of a material that has good mechanical properties and core loss characteristics. If, however, the material used has a low magnetic flux density there will be an increase in copper loss which in some cases may be enough to cancel out the decrease in core loss and any improvement in efficiency.

The rotor core material must therefore have good mechanical properties in the form of high tensile strength and fatigue strength, and at the same time it needs to exhibit low core loss at high frequencies and a high magnetic flux density.

Methods in general use for improving the mechanical strength of cold rolled steel sheet include solid solution hardening, precipitation hardening, hardening by grain refinement, and hardening through the use of a dual phase structure. In general there is a trade-off between higher mechanical strength on the one hand and lower core loss and improved magnetic flux density on the other: improving the two types of properties at the same time is difficult.

One known technique for increasing tensile strength, as disclosed by JP-A No. 60(1985)-238421, for example, is to increase the silicon to 3.5 to 7.0% and add elements to promote solid solution hardening. Because of the high degree of dependence on the silicon content, a drawback with this method is that the rolling temperature has to be maintained at 100° to 600° C., from hot rolling right through to cold rolling to the final thickness. Another problem with this technique is the very low magnetic flux density $B_{50}$ of the steel sheet, around 1.56 to 1.61 T.

In JP-A No. 61(1986)-9520, the silicon content is increased and elements are added to promote solid solution hardening, the resultant melt is rapidly solidified to form strip, which is cold rolled or warm rolled and annealed to produce high strength, low core loss non-oriented electrical steel sheet. Although with this method the silicon content is increased, the use of rapid-solidification alleviates the limitations of the embrittlement of the steel that resulted from conventional rolling techniques.

However, a problem has been that in order to achieve a tensile strength of, for example, 70 kg-f/mm$^2$ or more, the silicon content has to be increased to 4 to 4.5%, resulting in a very low $B_{50}$.

Another method disclosed in JP-A No. 55(1980)-65439 relates to the manufacture of very hard sendust alloy magnetic materials with high permeability. Such materials are mainly for static applications such as magnetic heads and small, high frequency transformers. Rotor cores for rotating machines are usually fabricated by laminating pieces of steel sheet that have been stamped out, and in operation are subjected to repeated rotation, stopping, and changes of speed. Because of this, the core material should be one in which the stamping process does not give rise to cracking, and with a high rupture strength to enable it to withstand being repeatedly subjected to stresses. Sendust alloy materials are very strong and wear-resistant, but at the same time they are also highly brittle, which has made such materials unsuitable for motor applications.

In JP-A No. 62(1987)-256917 the present inventors disclosed a high strength non-oriented electrical steel sheet, and a method of manufacturing the steel. This was followed by further detailed studies on the practical application of the invention. In these studies tensile tests conducted following stamping and ageing at 200° C. for 100 hours revealed that under normal conditions use of the appropriate manufacturing conditions produced the phenomenon of a marked reduction in the degree of elongation (see Table 1).

In this specification this phenomenon refers to microcracking in the test specimens caused by the stamping process and apparent embrittlement produced by strain ageing. As a yardstick, apparent embrittlement is judged to have taken place when total elongation following ageing (T-El) shows a decrease of 50 percent or more compared to total elongation prior to ageing. It has been termed apparent embrittlement because, as shown by Table 1, it is not discernable when the tensile test specimens are machine-finished rather than being just stamped. That is, for the purposes of evaluating mechanical properties the JIS procedure stipulates that the test specimens be machine-finished, and it is only when the JIS procedure is followed that no embrittlement (i.e., a decrease in the elongation) is discernable following the ageing. In practice, however, rotor cores are usually made of steel that is merely stamped out, with machine-finishing being used only in a very small proportion of cases, and as such, apparent embrittlement constitutes a practical problem.

steel has good magnetic properties in the class of YP≧60 kg-f/mm$^2$.

DETAILED DESCRIPTION OF THE INVENTION

Figure 1:
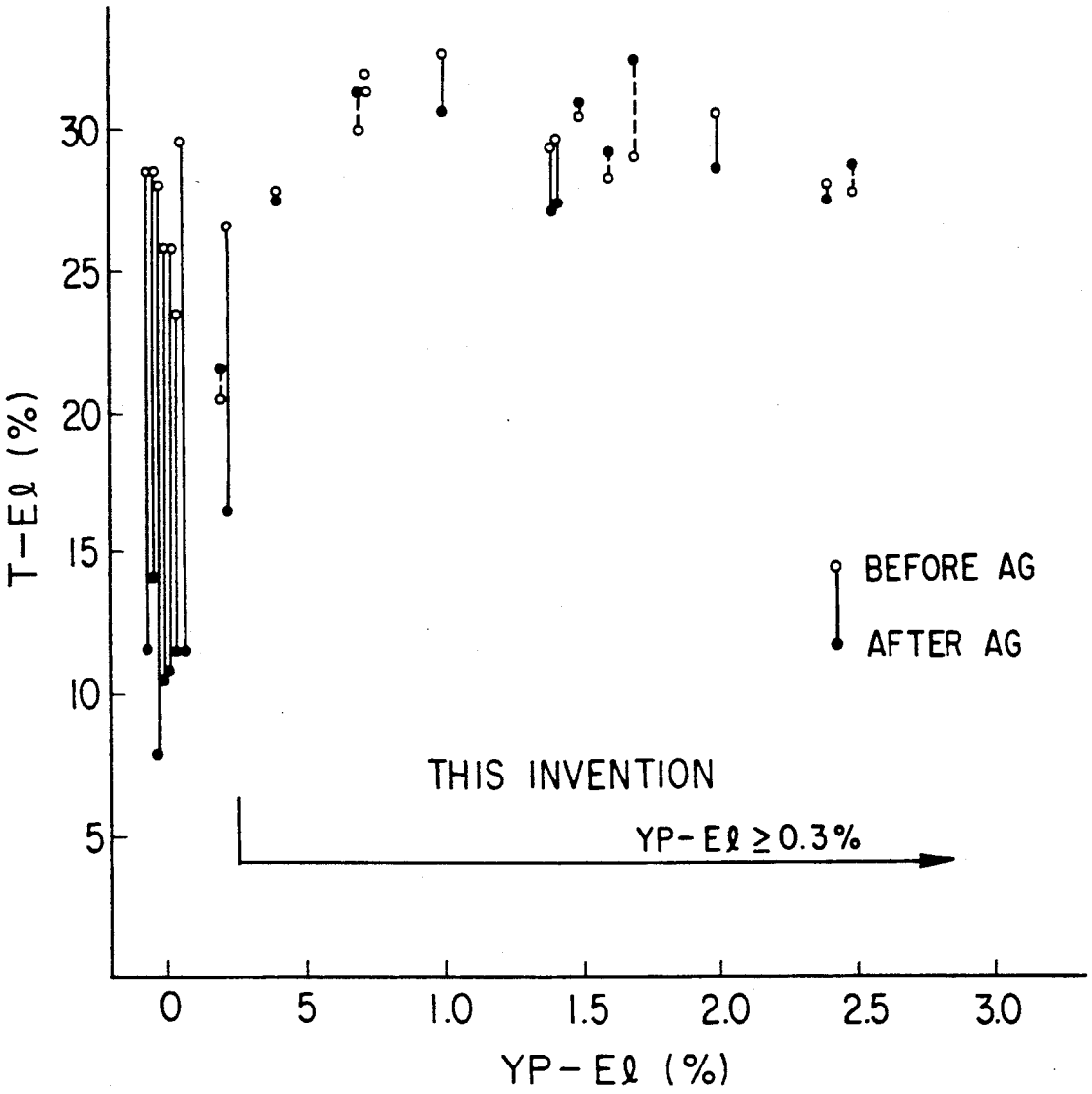
FIG. 1 illustrates the relationship between yield point elongation (YP-El) in machine-finished test specimens, and changes in total elongation in stamped test specimens following ageing, compared to total elongation prior to the ageing, i.e., apparent embrittlement.

The present inventors carried out numerous experiments to investigate the metallurgical factors that give rise to apparent embrittlement. This led to the new discovery illustrated in FIG. 1, which is that when the yield point elongation is very small, it produces a reduction in the elongation of stamped test specimens following ageing. It thus follows that an effective way of preventing apparent embrittlement is by maintaining the yield point elongation above a given value. Specifically, the problem of apparent embrittlement can be solved by maintaining the yield point elongation value by controlling the grain size of the final product by an optimum combination of composition conditions and annealing conditions.

Steel strengthening mechanisms include solid solution strengthening, precipitation strengthening, strengthening by grain refinement, strengthening by use of a dual phase structure, and work hardening. Each of these methods is accompanied by an unavoidable loss of the material's original 'soft' magnetic properties. However, compared with solid solution strengthening, precipitation strengthening and strengthening by grain refinement, strengthening by use of a dual phase structure or work hardening has a far greater adverse effect on the magnetism. Thus, a combination of the former three methods was employed to develop high strength non-oriented electrical steel sheet with good magnetic properties.

TABLE 1

| No. | Product thickness (mm) | Direction of test specimens | | Machine-finished test specimens YP (kgf/mm$^2$) | TS (kgf/mm$^2$) | T—El (%) | Punched test specimens YP (kgf/mm$^2$) | TS (kgf/mm$^2$) | T—El (%) | Apparent embrittlement |
|---|---|---|---|---|---|---|---|---|---|---|
| Case 1 | 0.65 | RD | Before AG | 61.3 | 71.3 | 26.7 | 62.6 | 72.5 | 21.6 | Observed |
| | | | After AG | 62.8 | 72.4 | 27.5 | 63.1 | 69.1 | 10.7 | |
| | | TD | Before AG | 64.5 | 72.9 | 27.6 | 65.3 | 74.5 | 29.5 | Observed |
| | | | After AG | 66.5 | 74.9 | 28.4 | 68.9 | 68.9 | 1.0 | |
| Case 2 | 0.50 | RD | Before AG | 63.0 | 72.2 | 28.0 | 63.8 | 73.5 | 26.9 | Not observed |
| | | | After AG | 64.1 | 73.4 | 26.9 | 63.7 | 73.0 | 20.0 | |
| | | TD | Before AG | 65.2 | 73.6 | 29.7 | 66.8 | 75.2 | 27.8 | Observed |
| | | | After AG | 66.8 | 75.1 | 27.7 | 66.7 | 66.7 | 6.1 | |

Note
RD; parallel to the rolling direction
TD; parallel to the transverse direction
AG; Aged at 200° C. for 100 hrs

SUMMARY OF THE INVENTION

An object of the present invention is to provide high strength non-oriented electrical steel sheet and a method of manufacturing the steel sheet, whereby the steel has good magnetic properties and mechanical properties that are adequate for enabling the steel to be utilized in stamped form.

Another object of the present invention is to provide a high strength non-oriented electrical steel sheet and a method of manufacturing the steel sheet, whereby the That is, the present invention consists of high strength non-oriented electrical steel sheet with good magnetic properties having a yield strength of ≧60 kg-f/mm$^2$ and a yield point elongation of YP-El≧0.3% comprising, by weight percent: up to 0.04% carbon; from 2.0% to less than 4.0% silicon; from zero percent to 2.0% aluminum; up to 0.2% phosphorus, and including one or more elements selected from manganese and nickel in an amount within the range $0.3\% \leqq Mn+Ni < 10\%$, with the remainder iron and unavoidable impurities.

The present invention also comprises a method of manufacturing high strength non-oriented electrical steel sheet with good magnetic properties having a yield strength of ≧60 kg-f/mm$^2$ and a yield point elongation of YP-El≧0.3% comprising forming a slab by continuous casting or blooming followed by hot rolling and, optionally, annealing, then pickling and cold rolling to the final thickness, followed by recrystallization at a temperature ranging from at least 650° C. to less than 900° C.

In accordance with this invention high strength non-oriented electrical steel sheet is obtained having a high yield strength, low core loss and high magnetic flux density that fully meets the high strength requirements for rotor materials imposed by the use of very high speeds in small motors and high speeds in medium-sized and large motors.

The invention includes two processes, process A and process B.

PROCESS A

The reasons for the component limitations specified for process A will now be explained.

Silicon increases the specific resistance of the steel and reduces eddy current, and as such is a highly effective element for reducing core loss. Silicon is also useful for increasing tensile strength, an effect which is insufficiently manifested if the amount added is less than 2.0%. Silicon also causes embrittlement of steel and lowers the saturation flux density of the product. Thus, with a view to making the invention usable on a commercial scale with existing rolling technology and to ensure a high magnetic flux density, an upper limit of 4.0% is specified.

An appropriate amount of aluminum is added to provide the same effect as silicon. Because aluminum may be left out, only an upper limit, of 2.0%, is specified, the amount being set with a view to avoid embrittlement.

Carbon is used to improve the strength of the steel. Because increasing the carbon content also increases the core loss, an upper limit of 0.01%, more preferably 0.005%, is specified.

Phosphorus has an extremely powerful strengthening effect, but it is known that it can produce boundary embrittlement in the steel through grain boundary segregation. To avoid this to enable the use of industrial-scale continuous casting, hot rolling and cold rolling, an upper limit of 0.2% is specified.

Manganese and nickel each have a relatively small adverse effect on the magnetic properties and a powerful promotional effect on strengthening by solid solution hardening. A combined manganese-nickel amount is specified because each element has about the same strengthening effect. The minimum combined amount has been set at 0.3% as being the level at which the effects of the elements are clearly manifested, while the maximum amount has been set at less than 10% as being the level at which the permissible decrease in magnetic flux density is reached.

In steel having the above composition, grain boundary embrittlement caused by the phosphorus can be a major problem. This can be avoided by the addition of a suitable amount of boron. The amount of added boron specified is 40±30 ppm. The effect boron has in mitigating grain boundary embrittlement is considered to come from the reduction in the grain boundary segregation of phosphorus resulting from site competition.

Limitations relating to the method of manufacture will now be explained.

Any known method may be employed for the continuous casting and hot rolling. A decision on whether or not to anneal the hot rolled sheet should be based on a consideration of the required magnetic and mechanical properties. Known methods may also be used for the cold rolling; it should be kept in mind that some steel compositions will be more suited to warm rolling.

The most important aspect concerns the annealing conditions upon which the grain size of the final product depends. To achieve a yield point elongation of YP-E1≧0.3% requires recrystallization at a temperature ranging from 650° C. to less than 850° C. The lower limit was set in view of the annealing temperatures and annealing times used commercially. This also applies to the upper limit of less than 850° C. for 30 seconds. While annealing can be carried out at higher temperatures, an upper limit of 850° C. is within the range employed commercially to ensure stable production.

PROCESS B

Some of the components used in process A are also used in process B, i.e. silicon, aluminum, phosphorus, manganese, boron and nickel. The explanation of the component limitations in process B will therefore only deal with other components.

Carbon

With niobium, zirconium, titanium and vanadium, carbon forms carbonitrides, strengthening the steel. However, as there is an increase in core loss with the increase in carbon content, an upper limit of 0.04% carbon has been specified.

Niobium and zirconium

At or below 0.1 the strengthening effect of Nb/8 (C+N) is insufficient, while 1.0 or more is disadvantageous in terms of cost and because it raises the recrystallization temperature. As zirconium can be expected to provided roughly the same effect as niobium, a range of at least 0.1 to less than 1.0 has been set for (Nb+Zr)/8 (C+N).

Titanium and vanadium

At or below 0.4 the strengthening effect of Ti/4 (C+N) is insufficient, while 4.0 or more is disadvantageous in terms of cost and because it raises the recrystallization temperature. As vanadium can be expected to provided roughly the same effect as titanium, a range of at least 0.4 to less than 4.0 has been set for (Ti+V)/4 (C+N).

When niobium, zirconium, titanium or vanadium are utilized to form carbonitrides, the carbon amount is limited to a maximum of 0.04%, as more than that gives rise to excessive deterioration in the magnetism.

Up to 50 ppm nitrogen is desirable.

The most important aspect of the production process concerns the annealing conditions upon which the grain size of the final product depends. In process B, recrystallization at a temperature ranging from 700° C. to less than 900° C. is required. The lower limit was set in view of the annealing temperatures and annealing times used commercially. This also applies to the upper limit of less than 900° C. for 30 seconds. While annealing can be carried out at higher temperatures, an upper limit of 900° C. is within the range employed commercially to ensure stable production.

The annealing may be carried out in a dry mixed gas of $H_2$ and $N_2$, for example.

EXAMPLE 1

Steels of the various compositions shown in Table 2 were cast into ingots which were heated to 1100° C. and rolled to form slabs. These were then reheated to 1100° C. and hot rolled into sheets 2.0 mm thick which were then annealed at 900° C. for 30 seconds, pickled and cold rolled to form sheets 0.5 mm thick. The cold rolled sheets were then annealed at 750°-900° C. for 30 seconds.

The resultant mechanical and magnetic properties are listed in Table 2. It can be seen from these results that raising the annealing temperature is accompanied by a linear decrease in the yield point elongation, and at a yield point elongation of YP-El≦0.2% there is a higher probability of apparent embrittlement occurring.

The figures for the mechanical properties are based on measurement data along the transverse direction.

TABLE 2

| | | Chemical composition | | | | | | | Annealing conditions | Magnetic properties | | Machine-finished (Before AG) | | | | Punching | |
|---|---|---|---|---|---|---|---|---|---|---|---|---|---|---|---|---|---|
| | | C* | Si | Mn | P | Ni | Al | B* | (°C.) | $W_{15/50}$ (W/kg) | $B_{50}$ (T) | YP (kgf/mm²) | TS (kgf/mm²) | YP—El (%) | T—El (%) | Before AG T—El (%) | After AG T—El (%) |
| This invention | (1) | 31 | 3.13 | 1.02 | 0.066 | 2.06 | 0.70 | 52 | 750 | 6.81 | 1.66 | 70.3 | 78.8 | 2.4 | 28.0 | 28.1 | 27.7 |
| This invention | (2) | " | " | " | " | " | " | " | 775 | 5.06 | 1.68 | 64.4 | 74.5 | 1.5 | 30.8 | 30.5 | 30.9 |
| This invention | (3) | " | " | " | " | " | " | " | 800 | 4.77 | 1.68 | 63.7 | 74.6 | 1.4 | 29.6 | 29.4 | 27.2 |
| Comparison | (1) | " | " | " | " | " | " | " | 850 | 4.10 | 1.67 | 61.4 | 71.9 | 0.2 | 28.0 | 20.4 | 21.5 |
| Comparison | (2) | " | " | " | " | " | " | " | 900 | 3.19 | 1.67 | 59.3 | 72.9 | 0.0 | 28.8 | 25.7 | 10.4 |
| This invention | (4) | 23 | 3.25 | 1.01 | 0.037 | 2.03 | 0.67 | 40 | 750 | 5.92 | 1.67 | 67.4 | 76.7 | 1.7 | 31.0 | 29.1 | 32.6 |
| This invention | (5) | " | " | " | " | " | " | " | 775 | 4.76 | 1.67 | 63.4 | 74.6 | 1.0 | 32.8 | 32.6 | 30.6 |
| This invention | (6) | " | " | " | " | " | " | " | 800 | 4.51 | 1.67 | 62.8 | 74.2 | 0.7 | 31.8 | 30.0 | 31.2 |
| Comparison | (3) | " | " | " | " | " | " | " | 850 | 3.86 | 1.67 | 61.4 | 73.8 | 0.2 | 32.4 | 26.5 | 16.4 |
| Comparison | (4) | " | " | " | " | " | " | " | 900 | 3.18 | 1.66 | 58.5 | 73.4 | 0.0 | 29.8 | 25.7 | 10.7 |
| This invention | (7) | 50 | 3.27 | 1.02 | 0.027 | 3.01 | 0.72 | 29 | 750 | 6.23 | 1.68 | 71.1 | 79.6 | 2.5 | 30.0 | 27.9 | 28.8 |
| This invention | (8) | " | " | " | " | " | " | " | 775 | 5.18 | 1.68 | 67.1 | 78.5 | 1.6 | 29.6 | 28.3 | 29.2 |
| This invention | (9) | " | " | " | " | " | " | " | 800 | 4.62 | 1.68 | 64.4 | 77.5 | 0.4 | 28.4 | 27.7 | 27.5 |
| Comparison | (5) | " | " | " | " | " | " | " | 850 | 3.75 | 1.67 | 61.5 | 76.7 | 0.0 | 28.4 | 23.4 | 11.4 |
| Comparison | (6) | " | " | " | " | " | " | " | 900 | 3.17 | 1.67 | 60.9 | 76.1 | 0.0 | 28.0 | 22.1 | 7.8 |

(* is ppm, other wt %)
Test specimens are JIS No. 6

EXAMPLE 2

Steels of the various compositions shown in Table 3 were cast into ingots which were heated to 1100° C. and rolled to form slabs. These were then reheated to 1100° C. and hot rolled into sheets 2.0 mm thick which were then annealed at 900° C. for 1 minute, pickled and cold rolled to form sheets 0.5 mm thick. The cold rolled sheets were then annealed at 750° C. for 30 seconds.

The resultant mechanical and magnetic properties are listed in Table 3.

The figures for the mechanical properties are based on measurement data taken transverse to the direction of rolling.

TABLE 3

| | Chemical composition | | | | | | | Magnetic properties | | Machine-finished (Before AG) | | | | Punching | |
|---|---|---|---|---|---|---|---|---|---|---|---|---|---|---|---|
| | C* | Si | Mn | P | Ni | Al | B* | $W_{15/50}$ (W/kg) | $B_{50}$ (T) | YP (kgf/mm²) | TS (kgf/mm²) | YP—El (%) | T—El (%) | Before Ag T—El (%) | After AG T—El (%) |
| This invention (10) | 18 | 3.05 | 1.00 | 0.062 | 2.05 | 0.70 | 1 | 7.36 | 1.66 | 72.5 | 82.9 | 1.8 | 22.8 | 22.6 | 18.4 |
| This invention (11) | 18 | 3.05 | 1.00 | 0.084 | 2.05 | 0.70 | 1 | 7.17 | 1.66 | 71.9 | 83.4 | 1.8 | 22.4 | 22.1 | 18.0 |

(* is ppm, other wt %)
Test specimens are JIS No. 6

EXAMPLE 3

Steels of the various compositions shown in Table 4 were cast into ingots which were heated to 1100° C. and rolled to form slabs. These were then reheated to 1100° C. and hot rolled into sheets 2.0 mm or 2.3 mm thick which, except for the inventive steel No. 15, were then annealed at 900° C. for 30 seconds, pickled and cold rolled to form sheets 0.5 mm or 0.65 mm thick. The cold rolled sheets were then annealed at 750° C. or 900° C. for 30 seconds.

The resultant mechanical and magnetic properties are listed in Table 4. From the figures of Table 4 it is apparent that an annealing at 900° C. for 30 seconds results in zero yield point elongation and the production of apparent embrittlement.

TABLE 4

| | Chemical composition | | | | | | | Thickness | Annealing conditions | Magnetic properties | | Machine-finished (Before AG) | | | | Punching | |
|---|---|---|---|---|---|---|---|---|---|---|---|---|---|---|---|---|---|
| | C* | Si | Mn | P | Ni | Al | B* | (mm) | (°C.) | $W_{15/50}$ (W/kg) | $B_{50}$ (T) | YP (kgf/mm²) | TS (kgf/mm²) | YP—El (%) | T—El (%) | Before AG T—El (%) | After AG T—El (%) |
| This invention (12) | 31 | 3.13 | 1.02 | 0.023 | 2.06 | 0.70 | 52 | 0.5 | 800 | 4.45 | 1.67 | 61.5 | 73.0 | 0.7 | 31.4 | 31.3 | 31.8 |
| Comparison (7) | " | " | " | " | " | " | " | " | 900 | 3.20 | 1.67 | 58.9 | 71.4 | 0.0 | 28.2 | 28.4 | 14.0 |
| This invention (13) | 31 | 3.13 | 1.02 | 0.066 | 2.06 | 0.70 | 52 | 0.5 | 800 | 4.77 | 1.68 | 63.7 | 74.6 | 1.4 | 29.6 | 29.7 | 27.5 |
| Comparison (8) | " | " | " | " | " | " | " | " | 900 | 3.19 | 1.67 | 59.3 | 72.9 | 0.0 | 28.8 | 28.5 | 11.5 |
| This invention (14) | 23 | 3.25 | 1.01 | 0.037 | 2.03 | 0.67 | 40 | 0.5 | 800 | 4.76 | 1.67 | 63.4 | 74.6 | 1.0 | 32.8 | 32.6 | 30.5 |
| Comparison (9) | " | " | " | " | " | " | " | " | 900 | 3.18 | 1.66 | 58.5 | 73.4 | 0.0 | 29.8 | 29.5 | 11.4 |
| This invention (15) | 37 | 3.20 | 0.20 | 0.043 | 2.50 | 0.72 | 37 | 0.65 | 750 | 6.10 | 1.68 | 64.4 | 75.0 | 2.0 | 30.6 | 30.6 | 28.8 |

(* is ppm, other wt %)
Test specimens are JIS No. 6

EXAMPLE 4

TABLE 5

| | Chemical composition | | | | | | | Magnetic properties | | Machine-finished (Before AG) | | | Punching | | |
|---|---|---|---|---|---|---|---|---|---|---|---|---|---|---|---|
| | C* | Si | Mn | P | Ni | Al | B* | $W_{15/50}$ (W/kg) | $B_{50}$ (T) | YP (kgf/mm²) | TS (kgf/mm²) | T—El (%) | Before AG T—El (%) | After AG T—El (%) | Apparent embrittlement |
| Comparison (10) | 24 | 3.00 | 1.02 | 0.107 | 2.03 | 0.70 | 6 | 5.92 | 1.69 | 62.8 | 77.1 | 30.0 | 29.0 | 10.5 | Observed |
| This invention (16) | 24 | 3.00 | 1.02 | 0.107 | 2.03 | 0.70 | 18 | 6.20 | 1.68 | 64.4 | 77.7 | 27.4 | 27.7 | 20.4 | Not observed |
| This invention (17) | 26 | 3.03 | 1.01 | 0.107 | 2.05 | 0.70 | 54 | 6.47 | 1.69 | 66.0 | 77.6 | 28.2 | 27.9 | 22.4 | Not observed |
| Comparison (11) | 26 | 3.03 | 1.01 | 0.107 | 2.05 | 0.70 | 81 | 6.56 | 1.68 | 61.8 | 77.7 | 29.2 | 28.5 | 14.1 | Observed |

(* is ppm, other wt %)
Test specimens are JIS No. 6

Steels of the various compositions shown in Table 5 were cast into ingots which were heated to 1100° C. and rolled to form slabs. These were then reheated to 1100° C. and hot rolled into sheets 2.0 mm thick which were then annealed at 900° C. for 1 minute, pickled and cold rolled to form sheets 0.5 mm thick. The cold rolled sheets were then annealed at 750° C. for 30 seconds.

The resultant mechanical and magnetic properties are listed in Table 5. Considerable apparent embrittlement was produced at boron levels of 6 ppm and 81 ppm, but the samples having 18 ppm and 54 ppm boron show that the addition of boron has a mitigating effect on apparent embrittlement.

EXAMPLE 5

Steels of the various compositions shown in Table 6 were cast into ingots which were heated to 1100° C. and rolled to form slabs. These were then reheated to 1100° C. and hot rolled into sheets 2.3 mm thick which were then pickled and cold rolled to form sheets 0.5 mm and 0.65 mm thick. The cold rolled sheets were then annealed at 750° C. to 800° C. for 30 seconds.

The resultant mechanical and magnetic properties are listed in Table 6.

TABLE 6

| | Chemical composition | | | | | | | | | | Annealing conditions |
|---|---|---|---|---|---|---|---|---|---|---|---|
| | C* | Si | Mn | P | Ni | Al | B* | N* | Nb* | Nb/8 (C + N) | (°C.) |
| Comparison (12) | 28 | 3.20 | 0.20 | 0.010 | 2.50 | 0.72 | 37 | 24 | tr | 0 | 775 |
| Comparison (13) | 23 | 2.98 | 1.03 | 0.105 | 2.04 | 0.69 | 42 | 25 | 20 | 0.05 | 800 |
| This invention (18) | 287 | 3.23 | 0.17 | 0.008 | 2.57 | 0.70 | 29 | 15 | 370 | 0.15 | 750 |
| This invention (19) | " | " | " | " | " | " | " | " | " | " | 800 |

| | Magnetic Properties | | JIS No. 6 (TD) | | | | Product thicks |
|---|---|---|---|---|---|---|---|
| | $W_{15/50}$ | $B_{50}$ | YP (kgf/mm²) | TS (kgf/mm²) | T—El (%) | YP—El (%) | (mm) |
| Comparison (12) | 5.54 | 1.69 | 61.3 | 72.6 | 32.6 | 1.3 | 0.65 |
| Comparison (13) | 5.91 | 1.67 | 63.5 | 70.8 | 12.7 | 3.2 | 0.50 |
| This invention (18) | 10.40 | 1.68 | 78.6 | 82.9 | 26.0 | 8.3 | 0.50 |

TABLE 6-continued

| | | | | | | | |
|---|---|---|---|---|---|---|---|
| This invention (19) | 9.53 | 1.67 | 79.8 | 82.2 | 26.0 | 6.9 | 0.50 |

(* is ppm, other wt %)

EXAMPLE 6

Steels of the various compositions shown in Table 7 were cast into ingots which were heated to 1100° C. and rolled to form slabs. These were then reheated to 1100° C. and hot rolled into sheets 1.8 mm or 2.0 mm thick. Some of these, as shown in Table 7, were then annealed at 900° C. for 1 minute, then pickled and cold rolled to form sheets 0.5 mm thick, while others were pickled and cold rolled to the same thickness without being annealed. The cold rolled sheets were then annealed at 750° C. or 800° C. for 30 seconds.

The resultant mechanical and magnetic properties are listed in Table 7.

TABLE 7

| | Chemical composition | | | | | | | | | | Annealing of hot rolling sheet (°C.) |
|---|---|---|---|---|---|---|---|---|---|---|---|
| | C* | Si | Mn | P | Ni | Al | B* | N* | Ti* | Ti/4 (C + N) | |
| Comparison (14) | 30 | 2.94 | 1.01 | 0.104 | 2.00 | 0.68 | 38 | 20 | 0.0064 | 0.32 | none |
| This invention (20) | 201 | 3.03 | 0.99 | 0.109 | 2.04 | 0.005 | 44 | 47 | 0.048 | 0.48 | 900 × 1' |
| This invention (21) | 201 | 3.03 | 0.99 | 0.109 | 2.04 | 0.70 | 44 | 41 | 0.057 | 0.60 | 900 × 1' |
| This invention (22) | 200 | 3.06 | 0.98 | 0.108 | 2.03 | 0.70 | 44 | 39 | 0.082 | 0.86 | 900 × 1' |
| This invention (23) | 120 | 3.04 | 1.01 | 0.101 | 2.02 | 0.74 | 51 | 47 | 0.093 | 1.39 | 900 × 1' |
| This invention (24) | 55 | 3.04 | 1.01 | 0.029 | 2.04 | 0.73 | 30 | 25 | 0.102 | 3.19 | none |
| Comparison (15) | 55 | 3.04 | 1.01 | 0.029 | 2.04 | 0.73 | 30 | 26 | 0.168 | 5.19 | none |

| | Finishing annealing (°C.) | Magnetic properties | | JIS No. 6 (TD) | | | |
|---|---|---|---|---|---|---|---|
| | | $W_{15/50}$ | $B_{50}$ | YP (kgf/mm²) | TS (kgf/mm²) | T—El (%) | YP—El (%) |
| Comparison (14) | 750 | | | 68.1 | 77.0 | 21.7 | 3.4 |
| This invention (20) | 750 | 7.71 | 1.68 | 72.2 | 79.1 | 28.3 | 5.7 |
| This invention (21) | 750 | 6.94 | 1.66 | 77.2 | 84.5 | 26.0 | 4.3 |
| This invention (22) | 750 | 7.19 | 1.65 | 73.3 | 84.3 | 23.7 | 2.0 |
| This invention (23) | 750 | 8.26 | 1.65 | 78.2 | 88.3 | 22.7 | 2.1 |
| This invention (24) | 800 | 7.81 | 1.61 | 70.4 | 82.4 | 19.2 | 1.2 |
| Comparison (15) | 750 | 10.6 | 1.56 | 87.1 | 92.2 | 6.8 | 0.0 |

(* is ppm, other wt %)

What is claimed is:

1. A method of manufacturing high strength non-oriented electrical steel sheet with good magnetic properties which comprises the steps of providing a steel melt containing, by weight percent: up to 0.04% carbon; from 2.0% to less than 4.0% silicon; from zero percent to 2.0% aluminum; up to 0.2% phosphorous, and including one or more elements selected from manganese and nickel in an amount within the range of $0.3\% \leqq Mn+Ni < 10\%$;

wherein in order to strengthen said steel by formation of carbonitrides at least one element selected from the group consisting of titanium and vanadium is added to the steel melt, wherein the amount of titanium and vanadium is defined by $0.4(Ti+V)/4(C+N) < 4.0$;

forming a slab by continuous casting or blooming;

hot rolling, followed by the inclusion or exclusion of an annealing step;

pickling and cold rolling to a final thickness; and recrystallization annealing at a temperature of at least 650° C. to less than 900° C.;

to achieve a steel sheet having a yield strength of 2460 kg-f/mm² and a yield point elongation of YP-El ≧ 0.3%.

2. The method as claimed in claim 1 in which the steel contains 40±30 ppm boron.

3. A method of manufacturing high strength non-oriented electrical steel sheet with good magnetic properties which comprises the steps of providing a steel melt containing, by weight percent: up to 0.04% carbon; from 2.0% to less than 4.0% silicon; from zero percent to 2.0% aluminium; up to 0.2% phosphorous, and including one or more elements selected from manganese and nickel in an amount within the range of $0.3\% \leqq Mn+Ni < 10\%$;

wherein in order to strengthen said steel by formation of carbonitrides at least one element selected from the group consisting of niobium and zirconium is added to the steel melt, wherein the amount of niobium and zirconium is defined by $0.1 < (Nb+Zr)/8(C+N) < 1.0$;

forming a slab by continuous casting or blooming;

hot rolling, followed by the inclusion or exclusion of an annealing step;

pickling and cold rolling to a final thickness; and recrystallization annealing at a temperature of at least 650° C. to less than 900° C.;

to achieve a steel sheet having a yield strength of ≧60 kg-f/mm² and a yield point elongation of YP-El ≧ 0.3%.

4. The method as claimed in claim 1 or 3 in which the annealing temperature is in a range from 700° C. to less than 900° C.

* * * * *

UNITED STATES PATENT AND TRADEMARK OFFICE

CERTIFICATE OF CORRECTION

PATENT NO. : 5,084,112

DATED : January 28, 1992

INVENTOR(S) : Ichiro TACHINO, et al.

It is certified that error appears in the above-identified patent and that said Letters Patent is hereby corrected as shown below:

Column 2, line 64, change "55(1980)-65439" to --55(1980)-65349--.

Column 4, line 3, change "DRAWINGS" to --DRAWING--.

Column 5, line 47, after "To avoid this" insert --so as-- before "to enable".

Column 6, line 40, change "provided" to --provide--.

Column 6, line 48, change "provided" to --provide--.

Column 8, line 13, under "Before" in the "Punching" colum, change "Ag" to --AG--.

Column 11, line 59, change "0.4(..." to --0.4<(...--.

UNITED STATES PATENT AND TRADEMARK OFFICE

CERTIFICATE OF CORRECTION

PATENT NO. : 5,084,112

DATED : January 28, 1992

INVENTOR(S) : Ichiro TACHINO, et al

It is certified that error appears in the above-indentified patent and that said Letters Patent is hereby corrected as shown below:

Column 12, line 9, change "2460" to -- ≧60--.

Signed and Sealed this

Eighth Day of June, 1993

*Attest:*

Michael K. Kirk

MICHAEL K. KIRK

*Attesting Officer*

*Acting Commissioner of Patents and Trademarks*